US010865033B2

(12) United States Patent
Zhang

(10) Patent No.: US 10,865,033 B2
(45) Date of Patent: Dec. 15, 2020

(54) PRODUCT DISPENSER AND METHOD FOR ASSEMBLING A PRODUCT DISPENSER

(71) Applicant: Derik (JiangSu) Industrial Co., LTD, ChangZhou (CN)

(72) Inventor: Shaoxiang Zhang, ChangZhou (CN)

(73) Assignee: Derik (Jiangsu) Industrial Co. Ltd., Changzhou (CN)

( * ) Notice: Subject to any disclaimer, the term of this patent is extended or adjusted under 35 U.S.C. 154(b) by 0 days.

(21) Appl. No.: 16/297,416

(22) Filed: Mar. 8, 2019

(65) Prior Publication Data

US 2020/0283221 A1 Sep. 10, 2020

(51) Int. Cl.
*B65D 1/40* (2006.01)
*B65D 83/00* (2006.01)

(52) U.S. Cl.
CPC ..... *B65D 83/0011* (2013.01); *B65D 1/40* (2013.01)

(58) Field of Classification Search
CPC .. A45D 40/04; A45D 40/06; A45D 2029/005; A45D 2040/0012; A45D 2040/0062
See application file for complete search history.

(56) References Cited

U.S. PATENT DOCUMENTS 5,172,993 A 12/1992 Ackermann et al.
5,186,560 A * 2/1993 Holloway ..... A45D 40/06 401/78
5,649,777 A 7/1997 Holloway
6,000,872 A 12/1999 Velicka et al.
6,116,801 A * 9/2000 Patel ..... A45D 40/06 401/78
6,200,047 B1 * 3/2001 Holloway ..... A45D 40/04 401/68
6,227,733 B1 * 5/2001 Holloway ..... A45D 40/04 132/318
6,231,254 B1 * 5/2001 Holloway ..... A45D 40/04 132/318
6,244,770 B1 * 6/2001 Holloway ..... A45D 40/06 401/75
7,112,002 B2 9/2006 Susini et al.
(Continued)

FOREIGN PATENT DOCUMENTS

WO 2008096148 A1 8/2008

*Primary Examiner* — Gene O Crawford
*Assistant Examiner* — Ayodeji T Ojofeitimi
(74) *Attorney, Agent, or Firm* — Robert A. Blaha; Smith Tempel Blaha LLC

(57) ABSTRACT

A sub-assembly and a method for manufacturing the sub-assembly are disclosed. The sub-assembly includes a shell, driver and a body. The shell is open at both ends and has a smooth inner wall. The driver has first and second portions with a channel arranged along an inner wall. The first portion of the driver is fixed to the shell. The body has an open end and a closed end. A set of flexible appendages compressively contact an inner wall over the second portion of the driver. The shell, driver and body are concentric tubes. A sub-assembly of a product dispenser is produced by pressing the first portion of the driver into the shell and inserting the body into the driver such that the flexible appendages compressively contact the inner wall of the driver. A product holder or cup can be introduced in the body to complete the assembly.

20 Claims, 8 Drawing Sheets

(56) References Cited

U.S. PATENT DOCUMENTS

| | | | | |
|---|---|---|---|---|
| 7,325,991 | B2 * | 2/2008 | Holloway | A45D 40/06 401/78 |
| 7,500,799 | B2 * | 3/2009 | Holloway | A45D 40/06 401/174 |
| 2003/0068187 | A1 * | 4/2003 | Holloway | A45D 40/12 401/78 |
| 2010/0054842 | A1 * | 3/2010 | DeVito | A45D 40/02 401/81 |
| 2015/0055997 | A1 * | 2/2015 | Holloway | A45D 40/24 401/31 |
| 2015/0208785 | A1 * | 7/2015 | Holloway | A45D 40/06 401/78 |
| 2015/0296958 | A1 * | 10/2015 | Holloway | A45D 40/06 401/78 |
| 2018/0070703 | A1 * | 3/2018 | Kikuchi | A45D 40/02 |
| 2019/0246768 | A1 * | 8/2019 | Xu | A45D 40/12 |

* cited by examiner

PRODUCT DISPENSER AND METHOD FOR ASSEMBLING A PRODUCT DISPENSER

TECHNICAL FIELD

The present dispenser relates, in general, to a container suitable for storing and controllably advancing a product from within the container.

TECHNOLOGICAL BACKGROUND

Commercially available product cartridges are often manufactured from one or more cylindrically shaped parts. One or more adhesives are often introduced to attach such cylinders to one another or to other parts when desired. In addition, one or more lubricants may be applied along internal surfaces of available product cartridges to reduce friction when the cartridge is operated.

The use of adhesives and lubricants contribute to the cost of the cartridges, may be difficult to store prior to their respective application in a manufacturing step, and introduce a host of other manufacturing related problems. For example, adhesives may trap particles or other contaminants, require time to cure, and often outgas while curing. In addition, the application of too much, too little or a contaminated adhesive or part may result in misalignment of mating parts, adhesive overflow or outflow onto external surfaces and/or failure of final assemblies. Lubricants may also trap particles or other contaminants and if applied in incorrect amounts can lead to outflow and/or inconsistent frictional quality between moving parts.

To avoid the necessity of lubricants various attempts have been made to provide biased tabs or lugs that extend radially to bear on a wall of an adjacent sleeve. However, the frictional quality of such mechanisms may be in need of further improvement.

Accordingly, there may be a need to provide an improved and consistently reproducible dispenser.

SUMMARY

There may be a need for dispenser that is simple to assemble without the use of adhesives and lubricants while still producing a dispenser with high reliability that provides a consistent and desired smoothness when manually manipulated to extend or retract a product from the dispenser.

According to an example embodiment, a sub-assembly of a product dispenser is provided. The sub-assembly includes a shell, a tubular driver and a tubular body. The tubular driver has a first portion and a second portion. The tubular driver is fixed to a shell along the first portion. The second portion of the tubular driver extends beyond the shell. An inward facing surface of a wall of the tubular driver defines a channel over the first portion and is smooth over the second portion. The tubular body has an open end and a closed end. The tubular body also has a set of flexible appendages extending from an outer surface between the open end and the closed end. The flexible appendages compressively contact the inward facing surface of the tubular driver.

According to another embodiment, a method of manufacturing a sub-assembly of a product dispenser is provided. The method includes providing a shell with opposed open ends and a smooth inward facing surface; providing a tubular driver having a first portion and a second portion, the first portion including splines over an external surface; pressing the first portion of the tubular driver into the shell, the splines fixing the first portion of the tubular driver within the shell with the second portion extending beyond the shell; providing a tubular body with an open end and an opposed closed end, the tubular body having a flange proximal to the open end and further having an annular stop surface, a second annular appendage and a set of flexible appendages extending from an outer surface in the second portion proximal to the closed end; and inserting the open end of the tubular body until the flange extends just past the tubular driver thus permitting the flexible appendages to compressively contact the inward facing surface of the wall of the tubular driver.

Overview of Embodiments

In the context of the present application, the term "product dispenser" may particularly denote an assembly of components which is capable of accommodating a product stick or product cylinder therein for providing both storage and mechanical support during use. Such product dispensers are useful for storing and applying lip balms and cosmetic products such as lipsticks. Alternatively, such product dispensers may be useful for storing and applying glue sticks or other solid products.

In the context of the present application, the term "portion" may particularly denote a continuous section of the tubular driver. A first portion may be characterized by a wall having an outer surface corresponding to a first outer diameter and a corresponding inward facing surface of the wall that defines a channel. The first portion also has an annular end surface. A second portion may be characterized by a second wall having an outer diameter different from the first outer diameter and a corresponding smooth inward facing surface. The second portion has a corresponding end surface and an adjacent tapered surface.

In an example embodiment, an intermediate or transition portion is disposed between the first portion and the second portion of the tubular driver. The intermediate portion may be characterized by a wall with opposed smooth surfaces. The intermediate portion may be further characterized by a wall that is thicker than respective walls of the first portion and of the second portion. When this is the case, the inner diameter of the first portion of the tubular driver will be different than a respective inner diameter of the second portion of the tubular driver.

In a preferred embodiment, the tubular driver includes splines arranged along the outward facing wall. The splines may start at the end of the first portion and continue over the length of the outer surface over the entirety of the first portion. In this preferred embodiment, the splines are evenly distributed about the entire circumference of the wall.

The splines may be arranged substantially parallel to a central axis of the tubular driver, are preferably solid and have a rounded profile when observed from the end of the first portion in a direction substantially parallel to a central axis of the tubular driver. The splines are arranged to contact an inner surface of the shell to provide an interference fit between the tubular driver and the shell. More specifically, that portion of a respective spline proximal to the apex of the rounded profile is arranged to contact the inner surface of the shell with minimal or substantially no resulting radial distortion of the tubular driver. A surface area of the splines in contact with the shell fixes the tubular driver to the shell.

In the illustrated embodiment the splines are evenly distributed about the circumference of the first portion of the tubular driver. Approximately one hundred such splines may be provided over the circumference of a dispenser suitable for storing and supporting a lipstick. It should be understood that a desired number of splines may be greater or fewer than one hundred and may vary with the circumference of the tubular driver and or the materials used to form the shell and the tubular driver. Furthermore, while it is preferred that the tubular driver and the shell are fixed in an entirely adhesive-free arrangement, the described interface between these elements is not so limited.

In a preferred embodiment, the shell is formed from a material having a hardness that is greater than that of a material used to form the tubular driver. For example, the shell may be made from metal or a combination of metallic elements and the tubular driver may be plastic.

In this preferred embodiment, the shell is a tube with a smooth inner wall having a diameter that provides an interference fit when the first portion of the tubular driver is pressed or otherwise introduced in the shell. One of the opposed ends of the shell may be provided with a rim. The tubular driver is inserted from an end opposite the rim until the end of the first portion of the tubular driver contacts the rim.

While the illustrated embodiment, shows a tubular shell with a smooth outer surface, it should be understood that the shell is not so limited. In other words, the shell may have one or more structures or surfaces that extend radially beyond a tubular driver. These alternative shells may form various geometric shapes or provide surfaces for grasping the shell. In still other embodiments, various designs or surface textures may be optionally provided along the outer surface of the shell as desired.

In the context of the present application, the term "flexible appendages" may particularly denote a set of hollow closed-cell structures that separately define respective volumes capable of being radially compressed when contacted along respective surfaces (of the separate appendages). The flexible appendages are arranged along an external wall between the closed end and an open end of the tubular body. When assembled in registration with the tubular driver, the second portion and more specifically, an inner smooth wall of the second portion of the tubular driver radially compresses the flexible appendages by displacing or deflecting the closed cells toward a central axis of the sub-assembly.

In a preferred embodiment, the flexible appendages are evenly spaced about the circumference of the tubular body. Approximately twenty such flexible appendages may be provided over the circumference of a tubular body of a suitable dispenser for storing and supporting a lipstick. It should be understood that a desired number of flexible appendages may be greater or fewer than twenty and may vary with the circumference of and material of the tubular body and or the materials used to form the tubular driver. In this preferred embodiment, the flexible appendages directly contact the wall of the tubular driver over a lubricant-free region.

While it is preferred that the flexible appendages rotate against the smooth inward facing surface of the second portion of the tubular driver in a lubricant-free arrangement, the described interface between these elements is not so limited.

It should be understood that the tapered surface adjacent to the end surface of the tubular driver enables the second portion of the tubular driver to pass over the set of flexible appendages on the opposed surface of the tubular body when inserting the tubular body in the tubular driver.

A separate or second appendage arranged along the tubular body limits the deflection of the flexible appendages and provides a separate contact region where the tubular driver and the tubular body overlap. In a preferred embodiment, the second appendage is solid, continuous, and arranged in close proximity to the flexible appendages. In this preferred embodiment, the second appendage has a curved surface where the appendage may contact the inward facing surface of the second portion of the tubular driver. However, the second appendage is not so limited as long as the second appendage or appendages do not extend (at their furthest) as far as the respective furthest point of the flexible appendages. In other words, the second appendage may be discontinuous and may have other than rounded cross-sectional shapes as long as the deflection of the flexible appendages is limited in the direction of the central axis.

The tubular body includes a third radially arranged appendage that extends from the outer surface. This third appendage is located proximal to the closed end and provides a stop surface arranged to closely abut a corresponding end or stop surface of the tubular driver.

The tubular body further includes an annular flange located proximal to the open end and a set of longitudinally arranged appendages along an external surface between the third radially arranged appendage and the closed end. The annular flange extends beyond and provides a stop surface to closely abut an end surface of the first portion of the tubular driver. The set of longitudinally arranged appendages define or provide a grip that enable manual rotation of the tubular body about its central axis with respect to the fixed combination of the shell and the tubular driver.

A wall of the tubular body defines opposed slots in a region that substantially overlaps the first portion of the tubular driver. At least one of the opposed slots may extend through to the open end of the tubular body to permit the introduction of a product holding cup. In addition, the slot extension permits non-destructive radial deflection toward the central axis of the tubular body when the open end is introduced through the volume of the tubular driver from the opening in the second portion in the direction of the opening in the opposed first portion.

The product cup fits inside the volume of the tubular body and is arranged with an open end for receiving a product stick or cylinder and has an opposed closed end. The product cup has a set of pins that extend radially from an external surface of a wall of the cup. The pins extend beyond the slots and into the channel in the tubular driver.

The product cup is further arranged with a set of radially arranged members that are supported along adjacent sides the wall and the bottom of the cup. In the illustrated embodiment, there are six identical members that form right triangles with a base connected to and extending from the bottom of the cup. However, it should be understood that the product cup is not so limited and may include a different number of members arranged to extend into and support a later introduced cylindrically shaped solid product such as a lipstick.

Advantageously, the generally described tubular driver and tubular body provide respective features that radially contact each other over a contact region that is lubricant free. Specifically, a set of flexible appendages arranged about the outer surface of the tubular body are radially compressed by an inner wall of the tubular driver. An annular appendage adjacent to the set of flexible appendages is configured to limit deflection of the flexible appendages. This elastic engagement of the complementary features of the tubular driver and the tubular body ensures a smooth feel when an operator grasps and turns the tubular body within the fixed combination of the shell and the tubular driver.

In addition, the generally described shell and tubular driver radially contact each other in an interference fit over the first portion of the tubular driver to provide a fixed connection between these elements over an adhesive-free contact region.

The above-described features separately and in combination contribute to a final assembly that is reliable, easily assembled, economical to produce and environmentally responsible as the final assembly can be adhesive and lubricant free.

In the following, further exemplary embodiments of a product dispenser and a method for manufacturing the same will be explained.

The described aspects and perhaps further aspects of an improved product dispenser will be or may become apparent from the illustrated examples to be described hereinafter and are explained with reference to these illustrated examples.

DETAILED DESCRIPTION OF ILLUSTRATED EMBODIMENTS

Figure 1:
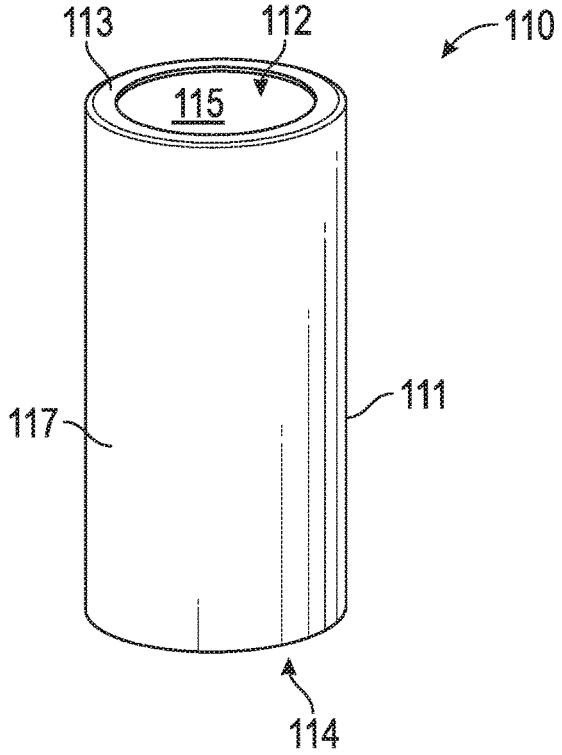
FIG. 1 illustrates a perspective view of an embodiment of a shell.

The illustrations in the drawings are schematically presented. In different drawings, similar or identical elements are provided with the same reference signs.

FIG. 1 includes a side perspective view of a shell 110. The shell is configured in the shape of a tube. The shell 110 has a wall 111 and opposed open ends 112, 114. The wall 111 has an inward facing surface 115 and an outer surface 117. At end 112, the wall 111 supports a rim or stop 113 that extends radially inward from the wall 111 toward a longitudinal axis of the shell. The rim or stop 113 abuts an adjacent end surface of a tubular driver 120 (FIG. 2) inserted in the opposed end 114 of the shell 110.

Figure 2:
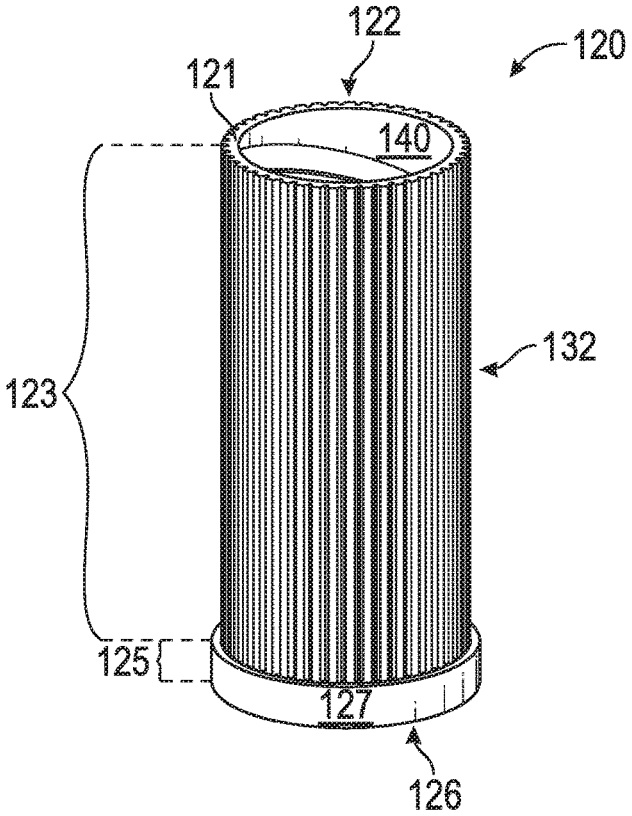
FIG. 2 illustrates a perspective view of an embodiment of a driver arranged to fit within the shell introduced in FIG. 1.

In a preferred embodiment, the shell 110 is made of a metal or an alloy, such as, aluminum. In the illustrated embodiment, the wall 111 is characterized by smooth surfaces 115, 117. In alternative embodiments, the surface 115 may be arranged with one or more channels or ribs configured to engage complementary features of the tubular driver 120 (FIG. 2). In still further embodiments a portion of or the entirety of the surface 117 may be knurled or otherwise made non-smooth such that surface 117 can be pinched or gripped by an operator.

The shell 110 defines a volume that receives and fixedly supports part of the tubular driver 120. That is, a diameter defined by the surface 115 of the wall 111 is selected to interfere or closely contact corresponding structures arranged along the tubular driver.

FIG. 2 illustrates a perspective view of an embodiment of a driver 120 arranged to fit within the shell 110 introduced in FIG. 1. The driver 120 includes a first portion or section 123 and a second portion or section 125. The driver 120, like the shell 110, is also configured in the shape of a tube. The driver 120 has opposed open ends 122, 126. In a preferred embodiment the driver 120 is plastic.

The first portion 123 has a wall 121 with an inward facing surface 140 and an outer surface 130. The outer surface 130 is characterized by splines 132 that extend radially therefrom. A respective apex of the splines 132 is arranged to closely contact the surface 115 of the shell 110. In the illustrated embodiment, the splines are arranged substantially parallel to a longitudinal axis of the driver 120. The splines are evenly distributed about the circumference of the first portion 123 of the driver 120. The splines 132 are narrow and numerous. In a preferred embodiment, the driver 120 is arranged with one hundred equally spaced splines 132.

It should be understood that other embodiments including more than one hundred splines 132 or less than one hundred splines 132 may achieve the desired result of fixedly attaching the shell 110 to the driver 120. These alternatives may also include splines 132 that do not extend over the entire length of the first portion 123 of the driver 120, arranging splines 132 with alternating lengths, and/or arranging splines 132 with one or more gaps, etc.

The second portion 125, which is proximal to the end 126 of the driver 120, is characterized by a wall 124 with smooth inner (not shown) and outer surfaces 127. The wall 124 has an outer diameter that extends further radially from the longitudinal axis of the driver 120 than the respective outer wall of the first portion 123 of the driver. The wall 124 has an inner diameter that approximates the furthest or base surface of the channel 145 in the wall over the first portion 123.

Figure 4:
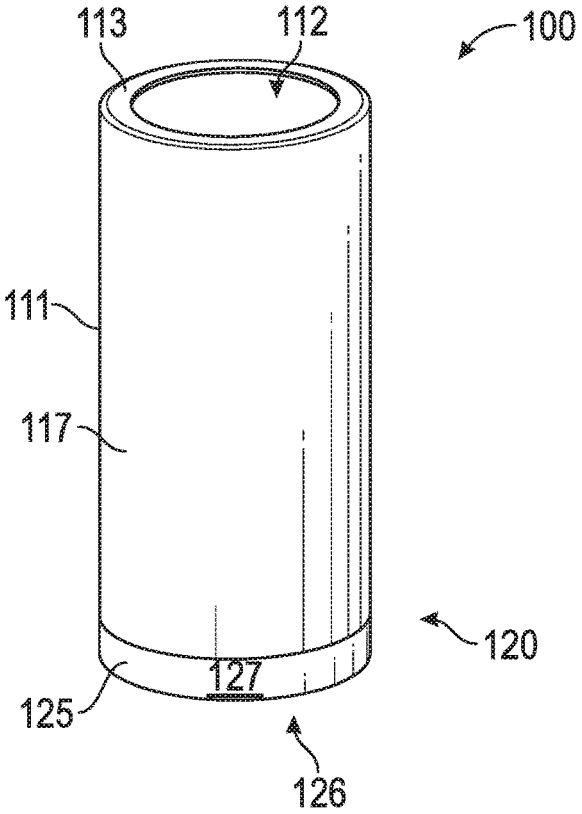
FIG. 4 illustrates a perspective view of the shell and the driver introduced in FIG. 1 and FIG. 2, respectively.
Figure 5:
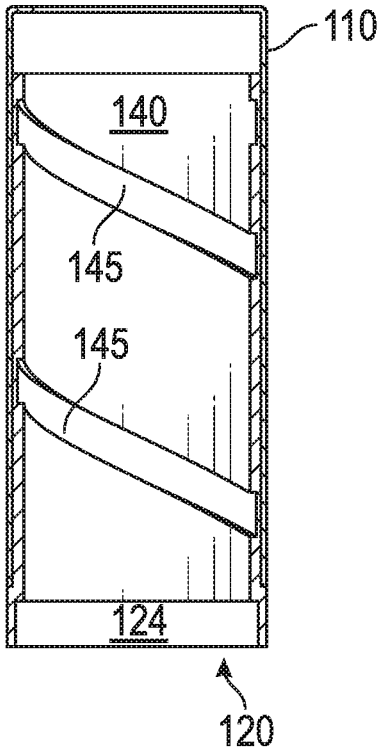
FIG. 5 illustrates a sectional view of the shell and driver assembled as in FIG. 4.

FIG. 5 illustrates a sectional view of the shell 110 and driver 120 assembled as in FIG. 4. As can be observed in the sectional view presented in FIG. 5, the driver 120 may have a relatively short transition between the first portion 123 and the second portion 125. The wall of the driver 120 is relatively thicker at the transition than the wall over the first portion 123 above the transition and over the second portion 125 below the transition.

Figure 3:
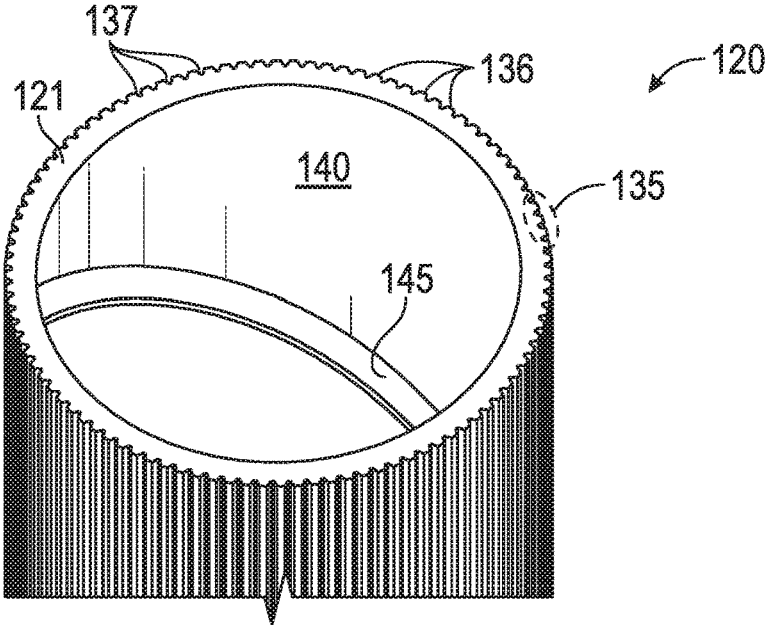
FIG. 3 illustrates a detailed perspective view of a portion of the driver introduced in FIG. 2.

As also illustrated in FIG. 3, the inner surface 140 defines a channel 145 that is open to the volume enclosed by the first portion 123 of the driver 120. The channel 145 is inclined or sloped with respect to an end surface of the wall 121. The channel 145 is closed near the end 122 and open to the volume defined by the second portion 125 of the driver 120.

FIG. 3 illustrates a detailed perspective view of the end 122 at the first portion 123 of the driver 120 introduced in FIG. 2. A profile 135 along the outer circumference of the wall 121 of the driver 120, as defined by the longitudinally arranged splines 132, forms a series of apexes 136 with any two adjacent apexes 136 separated by a respective valley 137. Preferably, the individual apexes 136 are curved and smooth along the length of the driver 120.

FIG. 4 illustrates a perspective view of the shell 110 and the driver 120 introduced in FIG. 1 and FIG. 2, respectively, when the tubular driver 120 is assembled or in registration with the shell 110. When the driver 120 is in registration with the shell 110, and end surface of the wall 111 of the shell 110 abuts an uppermost surface of the second portion 125. When so assembled, the contact area between the apexes 136 of the splines 132 of the driver 120 and the surface 115 of the shell is sufficient to fix the driver 120 to the shell 110. Accordingly, these elements can be fixed in the absence of any adhesive.

As further shown in FIG. 4, the outer diameter of the shell closely corresponds to an outer diameter of the driver 120 over the second portion 125 such that the transition between the outer surface 117 of the shell 110 and the outer surface 127 of the driver 120 is smooth.

Figure 6:
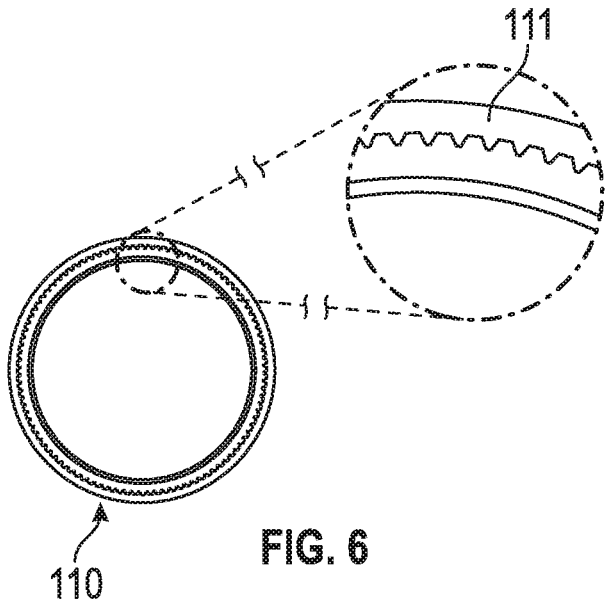
FIG. 6 illustrates a detailed cross-sectional view in the direction of line 6-6 as shown in FIG. 14.
Figure 14:
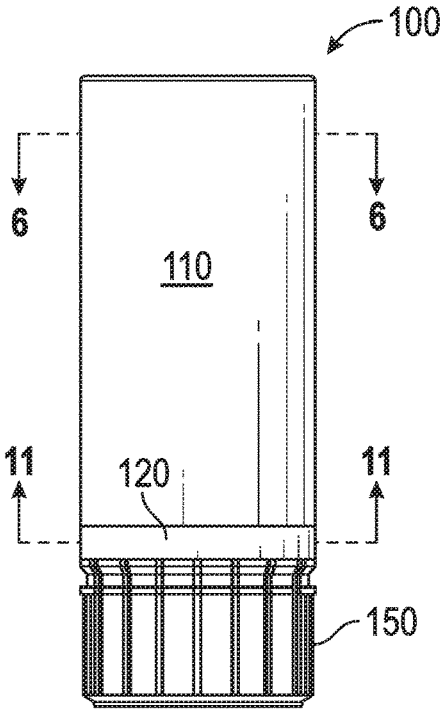
FIG. 14 illustrates a side view of an embodiment of an assembly.

FIG. 6 illustrates a detailed cross-sectional view in the direction of line 6-6 as shown in FIG. 14. As illustrated, the relatively smooth inner surface 115 of the wall 111 of the shell 110 closely surrounds and contacts the many splines 132 arranged along the circumference of the first portion 123 of the driver 120. Such an arrangement may prevent relative rotation of the driver 120 and the shell 110.

Figure 7:
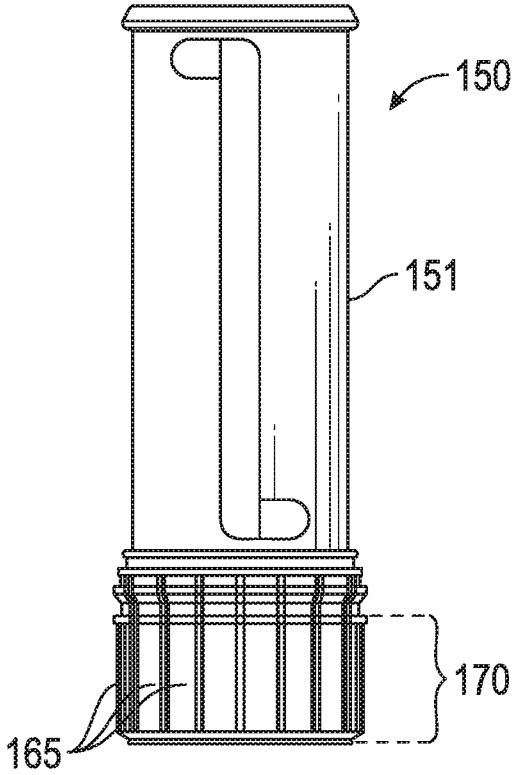
FIG. 7 illustrates a side view of an embodiment of a tubular body arranged to partially fit within the driver of FIG. 2.

FIG. 7 illustrates a side view of an embodiment of a tubular body 150 arranged to partially fit within the driver 120 of FIG. 2. The body 150, similar to the shell 110 and the driver 120, is configured in the shape of a tube. In a preferred embodiment, the body 150 is plastic. The body 150 has a wall 151 and opposed ends 152, 154. End 152 is open. An engaging flange 173 is located along the wall 151 at the open end 152. The engaging flange 173 is arranged with a tapered or leading surface that permits the tubular body 150 to be inserted into the volume defined by the tubular driver 120. The engaging flange 173 is further arranged with a contact surface that will permit rotation of the tubular body 150 within the driver 120. Once engaged along the end surface of the wall of the driver 120, the contact surface prevents an operator from removing the body 150 from the fixed combination of the driver 120 and the shell 110.

A base or plate 176 is located at the opposed end 154. The wall 151 has an inward facing surface 115 and an outer surface 117. The wall 151 defines opposed slots 172. The slots 172 are substantially parallel to each other and with a longitudinal axis of the body 150. As shown in FIG. 7, the slots 172 have a lower end extension and an opposed upper end extension that increase a dimension of the slot in a direction substantially parallel to a plane of the base or plate 176 at the closed end 154. The lower end extension and the upper end extension further open the slot 172 in opposed directions with respect to one another.

Figure 13:
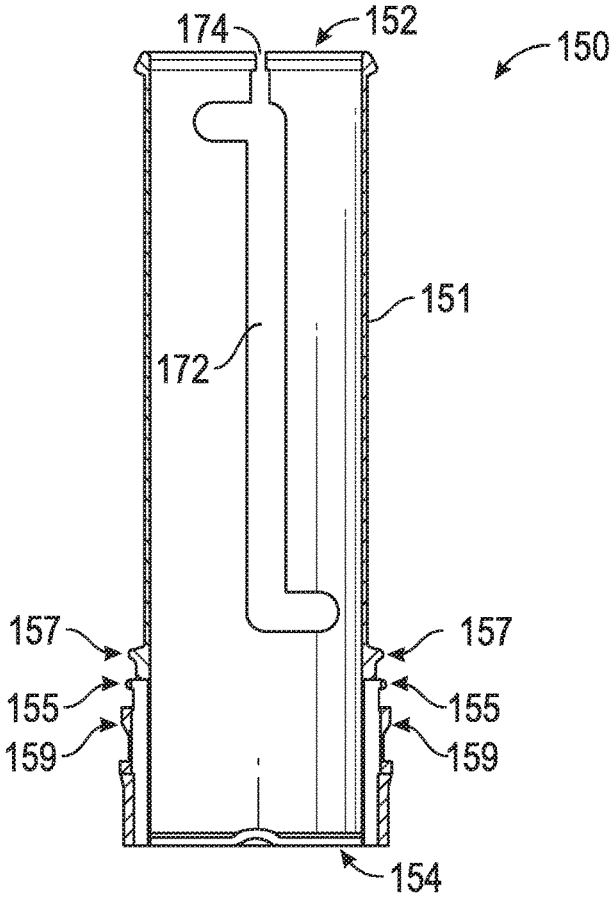
FIG. 13 illustrates a complete cross-sectional view of the tubular body of FIG. 7.

As can be observed in FIG. 13, one of the two opposed slots 172 has an additional extension or slot 174 that exposes the slot 172 to the open end 152. The slot 174 enables inward radial deflection of the engaging flange 173 when the body is introduced into the driver 120. In addition, the slot 174 permits outward radial deflection of the body 150 at the open end 152 to introduce a cup or holder.

Figure 10:
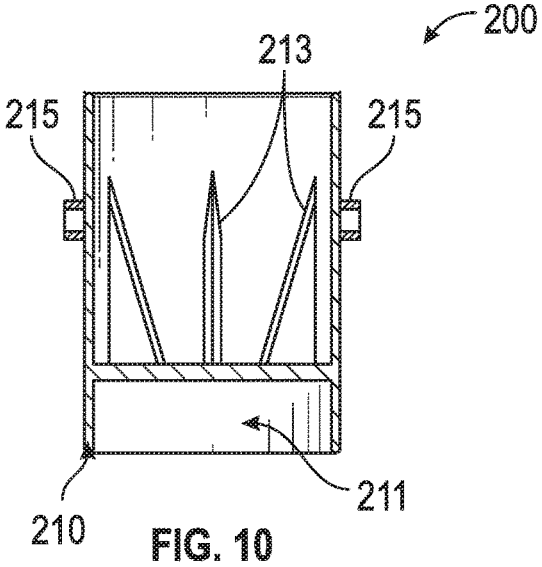

The wall 151 increases in thickness proximal to the closed end 154. An annular set of flexible appendages 155 extends radially from the wall 151. Each member of the set of flexible appendages 155 is curved or rounded at its apex and as can be seen in FIG. 10 encases a respective hollow closed cell 160 that provides radially resilient compression when closely contacted by a relatively more resilient surface. A separate annular appendage 157 is located adjacent to the set of flexible appendages 155. The annular appendage 157 extends radially from the wall 151, is relatively much more resilient than the adjacent flexible appendages 155, and limits radial deflection of the flexible appendages 155 towards a central axis of the assembly 100.

It should be understood that the illustrated arrangement may be changed such that the flexible appendages 155 are located further from the closed end 154 than the annular appendage 157 while still achieving the same goal of limiting the radial compression of the flexible appendages 155 when the body 150 is in registration with the driver 120.

Figure 12:
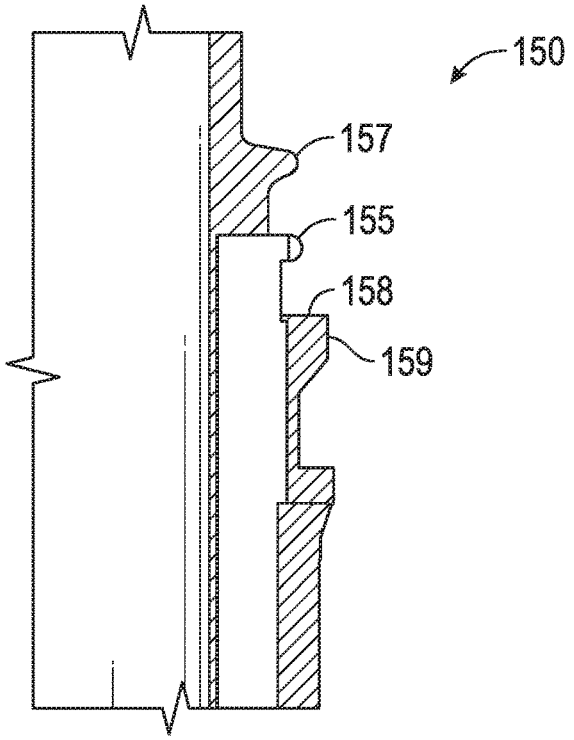
FIG. 12 illustrates a detailed cross-sectional view of the tubular body of FIG. 7.

As can be observed in the detail view illustrated in FIG. 12 an annular appendage 159 located proximal to the grip 170 at the closed end 154 of the body 150 provides a stop surface 158 arranged to closely abut a complementary end surface of the driver 120 when the body 150 is in registration with the driver 120 and the shell 110 as shown in FIG. 14.

As further illustrated in FIG. 7, a grip section 170 of the body 150 includes a set of longitudinally arranged appendages 165. As can be observed in FIG. 14, when the body 150 is in registration with the driver 120 and the shell 110, the grip section 170 and the adjacent annular appendage 159 are exposed with the remainder of the body 150 located within the volume defined by the driver 120. The grip section 170 provides a surface that can be manipulated by an operator to rotate the body 150 with respect to the fixed combination of the driver 120 and the shell 110.

Figure 11:
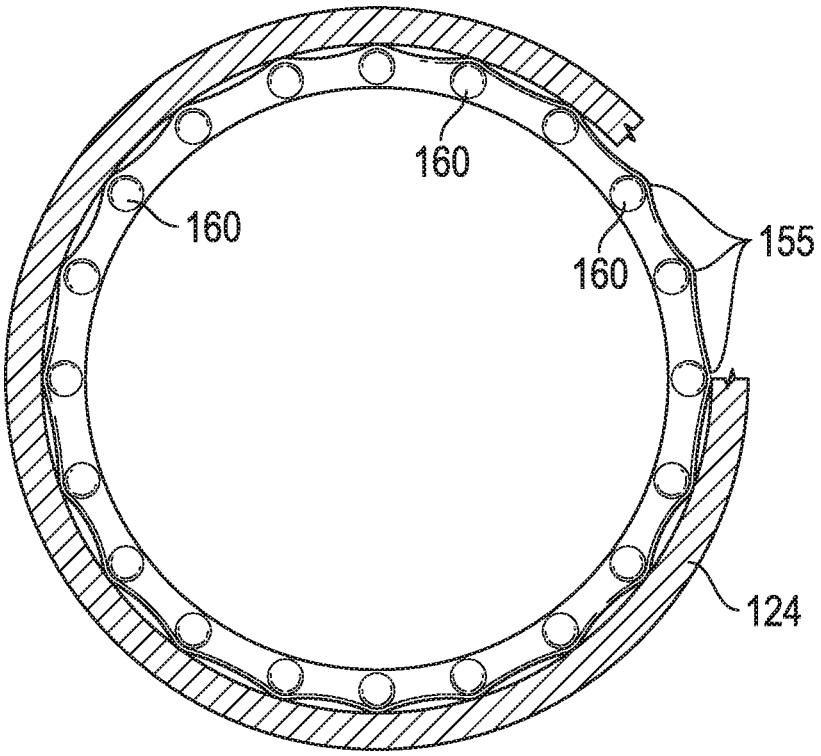
FIG. 11 illustrates a detailed cross-sectional view of the tubular body in registration with the driver in the direction of line 11-11 as shown in FIG. 14.

FIG. 11 illustrates a detailed sectional view of the concentric relationship of the tubular body 150 introduced in FIG. 7 and the wall 124 of the second portion 125 of the driver 120. As illustrated, the inner diameter of the wall 124, which is consistent and smooth, radially compresses the respective flexible appendages 155 distributed around the circumference of the body 150.

In the illustrated embodiment, the tubular body 150 is arranged with twenty evenly distributed flexible appendages 155. It should be understood that other embodiments including more than twenty flexible appendages 155 or less than twenty flexible appendages 155 may in conjunction with the annular appendage 157 that limits the radial compression and contact area between this portion of the body 150 and the concentric wall 124 of the driver 120 may achieve the desired result of providing a smooth and consistent feel as the body 150 and any product supported therein rotates within the driver 120.

Figure 8:
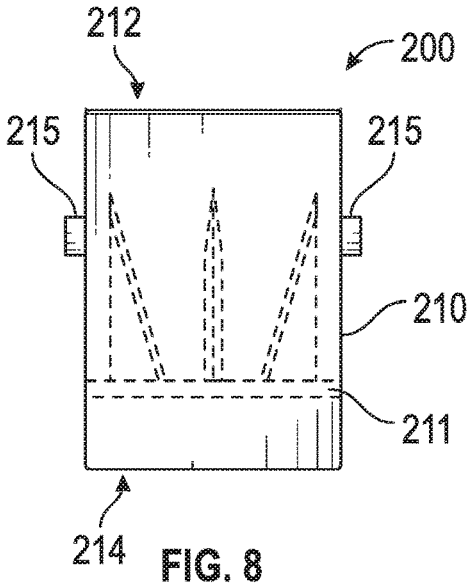
FIG. 8, FIG. 9 and FIG. 10 illustrate a side, bottom and cross-sectional view, respectively, of an embodiment of a product cup arranged to fit within the tubular body introduced in FIG. 7.
Figure 9:
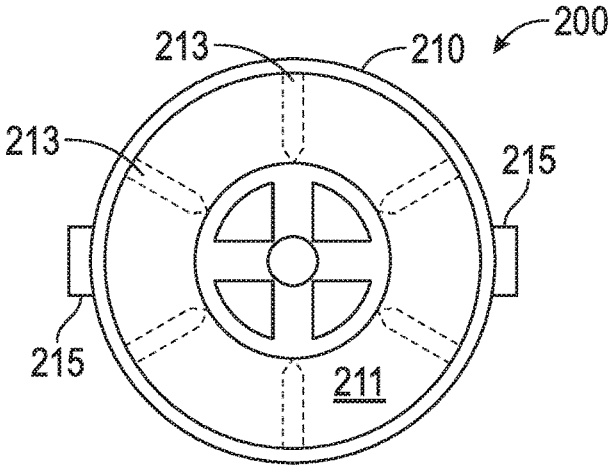

FIG. 8 and FIG. 9 illustrate a side view and a bottom view, respectively, of an embodiment of a product holding cup 200 arranged to fit within the tubular body 150 introduced in FIG. 7. The cup 200, similar to the shell 110, the driver 120, and the body 150, is configured in the shape of a tube. In a preferred embodiment, the cup 200 is plastic. The cup 200 has a wall 210 and opposed open ends 212, 214. A circular plate 211 proximal to but separate from end 214 provides a base to support a product cylinder such as a lipstick. The cup 200 is arranged with opposed pins 215 that extend radially from the wall 210. The pins 215 extend through the slot 172 in the wall 151 of the body 150 and fit within the channel 145 in the inner wall 140 of the driver 120. As shown with hidden lines FIG. 8 and as referenced in FIG. 9, the plate 211 may support a set of holders 213 that connect the plate 211 to the wall 210 of the cup 200. In the illustrated embodiment the cup 200 includes six evenly distributed holders 213 arranged as right triangles. In addition, a set of pie-slice shaped ports extend through the plate 211 may surround cross-shaped members at the center of the cup 200.

As can be observed in section view presented in FIG. 10, the holders 213 have a base that extends from the plate 211 and an adjacent leg that extends from the wall 210. The holders 213 may be arranged with tapered surfaces that meet along the edge of the inclined leg to enable the holders 213 to penetrate an end of a product cylinder (not shown) when the product cylinder is pressed or otherwise advanced to the plate 211 of the cup 200.

Figure 15:
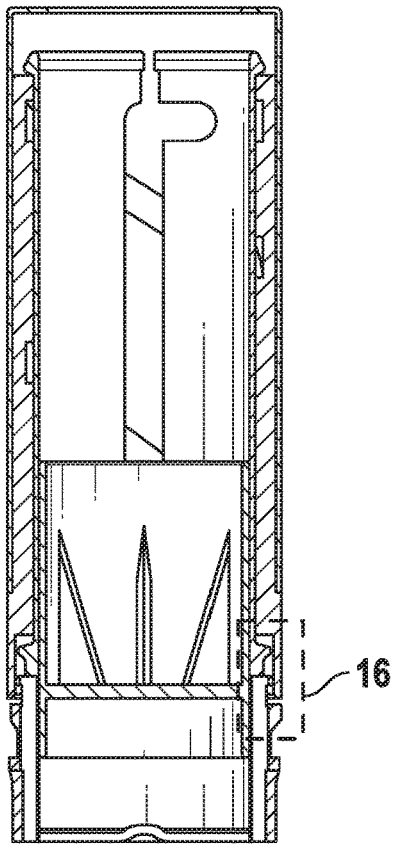
FIG. 15 illustrates a cross-sectional view of the assembly of FIG. 14.

The cross-sectional view of the assembly 100 in FIG. 15 illustrates the concentric relationship of the cup 200, body 150, driver 120 and shell 110. That is, an outer diameter of the wall 210 of the cup 200 closely fits within the volume defined by the inner diameter of the wall 151 of the body 150. Similarly, an outer diameter of the wall 151 closely fits within a respective volume defined by the inner diameter of the wall 121 over the first portion 123 of the driver 120. As described, the wall 124 at the second portion 125 of the driver 120 has an outer diameter that closely corresponds to an outer diameter of the shell 110. Furthermore, the wall 124 at the second portion 125 of the driver 120 has an inner diameter that interferes with the flexible appendages 155 that extend from the wall 151 of the body 150.

Figure 16:
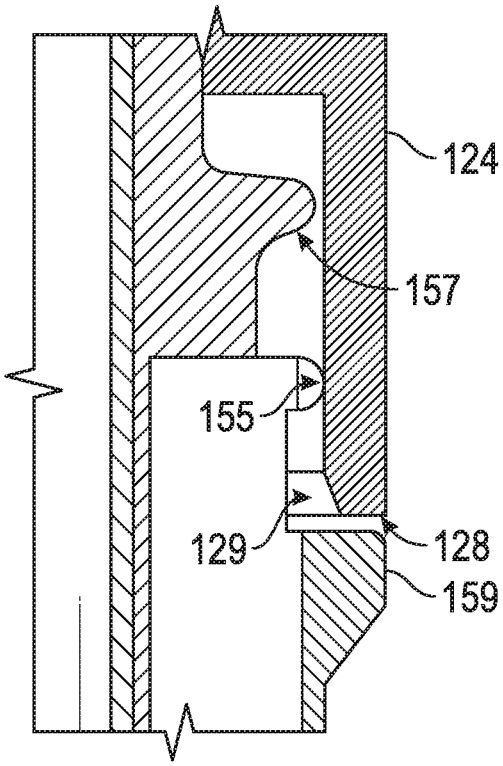
FIG. 16 illustrates a detailed sectional view of a portion of the assembly of FIG. 14.

FIG. 16 illustrates a detailed sectional view of a portion of the assembly 100. The wall 124 has an outer diameter that closely corresponds to a respective outer diameter of the appendage 159 that extends radially from the wall 151 of the body 150. The wall 124 has an end surface 128 that closely abuts an upper or stop surface 158 of the appendage 159. A tapered surface 129 adjacent to the end surface 128 enables the driver 120 to elastically engage the apex of the respective flexible appendages 155. The resultant radial deflection is limited by the outer diameter of the adjacent annular appendage 157.

In view of the foregoing, a method for assembling a product cartridge includes providing a shell 110 having opposed open ends 112, 114, the shell 110 having an inward facing surface 115 along a wall 111; providing a tubular driver 120 having a first portion 123 and a second portion 125, the first portion 123 including splines 132 along an external surface of the tubular driver 120; pressing the first portion 123 of the tubular driver 120 into the shell 110, the splines 132 fixing the first portion 123 of the tubular driver 120 within the shell 110 with the second portion 125 extending beyond the shell 110; providing a tubular body 150 having an open end 152 and an opposed closed end 154, the tubular body 150 further having a flange 173 proximal to the open end 152 and also having an annular stop surface 158, a second annular appendage 157 and a set of flexible appendages 155 extending from an outer surface proximal to the closed end 154; inserting a cup with opposed appendages that pass through a wall of the tubular body into a channel of the driver; inserting the open end 152 of the tubular body 150 into the volume defined by the fixed combination of the driver 120 and the shell 110 until the engaging flange 173 extends just past the end surface of the wall of the tubular driver 120 thus permitting the flexible appendages 155 to compressively contact the inward facing surface of the wall 124 in the second section 125 of the tubular driver 120.

Once the assembly is completed, an end of a product such as a lipstick arranged as a cylinder can be introduced through the remaining open end 112 of the shell 110 and engaged by the holders 213 in the cup 200.

In operation, the assembly 100 can be manipulated by relative rotation of the body 150 and the cup 200 therein with respect to the fixed combination of the driver 120 and the shell 110. Such rotation in a first direction about a central axis of the assembly 100 will translate the cup 200 and the supported product cylinder toward the closed end or grip 170 of the body 150. Specifically, for the incline of the channel 145 in the inner wall 140 of the driver 120, as shown in the illustrated embodiment, an anti-clockwise rotation applied to the grip 170 guides or directs the pins 215 extending radially from the cup 200 against the channel 145 to move the cup 200 towards the grip 170. Conversely, a clockwise rotation applied to the grip 170 directs the cup 200 up the incline and advances the product cylinder through the open end 112 of the shell 110. The pins 215 extending from the cup 200 interact with the extensions in the slot 172 of the body 150 to limit translation of the cup 200.

It should be noted that the term "comprising" does not exclude other elements or steps and the article "a" or "an" does not exclude a plurality. Also, elements described in association with different embodiments may be combined.

The sub-assembly and any final assembly constructed therewith is not limited to the preferred embodiment shown in the figures and described above. Instead, variants are possible which use the illustrated structures, arrangements and principles even in the case of fundamentally different embodiments.

The invention claimed is:

1. An assembly for storing and advancing a product, the assembly, comprising:

a tubular driver having a first portion and a second portion, the tubular driver fixed to a shell along the first portion with the second portion extending beyond the shell, the tubular driver defining a channel along an inward facing surface;

a tubular body with an open end and an opposed closed end, a set of flexible appendages extending from an outer surface between the open end and the closed end, the set of flexible appendages arranged to compressively contact the inward facing surface of the tubular driver, wherein the tubular body has a first annular appendage that extends from the outer surface between the open end and the closed end, the first annular appendage arranged to limit deflection of the set of flexible appendages.

2. The assembly of claim 1, wherein the tubular driver and the shell are fixed in an adhesive-free arrangement.

3. The assembly of claim 1, wherein the tubular driver includes splines arranged along an outward facing surface that interfere with the shell.

4. The assembly of claim 1, wherein members of the set of flexible appendages are evenly spaced about the circumference of the tubular body.

5. The assembly of claim 1, wherein the set of flexible appendages directly contact the tubular driver over a lubricant-free region.

6. The assembly of claim 1, wherein the set of flexible appendages are radially compressible.

7. The assembly of claim 1, wherein the set of flexible appendages are hollow.

8. The assembly of claim 1, wherein the tubular body has a second annular appendage that extends from the outer surface between the set of flexible appendages and the closed end.

9. The assembly of claim 8, wherein the second annular appendage includes an annular stop surface.

10. The assembly of claim 9, wherein the second portion of the tubular driver includes a tapered surface adjacent to a corresponding stop surface, the annular stop surface of the tubular body abutting the corresponding stop surface of the tubular driver.

11. The assembly of claim 3, wherein the splines are arranged substantially parallel to a longitudinal axis of the tubular driver.

12. The assembly of claim 3, wherein the splines are evenly distributed about the circumference of the tubular driver.

13. The assembly of claim 3, wherein the splines have a rounded profile.

14. The assembly of claim 3, wherein the shell is formed from a harder material than the tubular driver.

15. The assembly of claim 1, wherein the tubular body includes an annular flange proximal to the open end and opposed slots defined in a region substantially overlapping the tubular driver.

16. The assembly of claim 15, further comprising:

a cup with pins extending radially from an external surface, the pins configured to extend beyond the slots and into the channel.

17. The assembly of claim 1, wherein the tubular body is arranged with longitudinally arranged appendages proximal to the closed end.

18. The assembly of claim 17, wherein the longitudinally arranged appendages define a grip for rotationally manipulating the tubular body with respect to the tubular driver and the shell.

19. A method for assembling a sub-assembly of a product cartridge, the method comprising:

providing a shell having opposed open ends, the shell having a smooth inward facing surface;

providing a tubular driver having a first portion and a second portion, the first portion including longitudinal splines over an external surface;

pressing the first portion of the tubular driver into the shell, the longitudinal splines fixing the first portion of the tubular driver within the shell with the second portion of the tubular driver extending beyond the shell;

providing a tubular body with an open end and an opposed closed end, the tubular body having a flange proximal to the open end and further having an annular stop surface, a second annular appendage and a set of flexible appendages extending from an outer surface proximal to the closed end;

inserting a cup with opposed appendages that pass through the tubular body into a channel of the tubular driver;

inserting the open end of the tubular body until the flange extends just past the tubular driver thus permitting the flexible appendages to compressively contact an inward facing surface of the tubular driver.

20. An assembly for storing and advancing a product, the assembly, comprising:

a tubular driver having a first portion and a second portion, the tubular driver fixed to a shell along the first portion with the second portion extending beyond the shell, the tubular driver defining a channel along an inward facing surface;

a tubular body with an open end and an opposed closed end, a set of flexible appendages extending from an outer surface between the open end and the closed end, the set of flexible appendages arranged to compressively contact the inward facing surface of the tubular driver, wherein the set of flexible appendages are hollow.

* * * * *